United States Patent [19]

Ayer et al.

[11] Patent Number: 4,755,240

[45] Date of Patent: Jul. 5, 1988

[54] NICKEL BASE PRECIPITATION HARDENED ALLOYS HAVING IMPROVED RESISTANCE STRESS CORROSION CRACKING

[75] Inventors: Reghavan Ayer, Stamford, Conn.; Glen A. Vaughn; Lawrence J. Sykes, both of Houston, Tex.

[73] Assignees: Exxon Production Research Company, Houston, Tex.; Exxon Research and Engineering Company, Florham Park, N.J.

[21] Appl. No.: 861,941

[22] Filed: May 12, 1986

[51] Int. Cl.[4] ..... C22C 19/05

[52] U.S. Cl. ..... 148/410; 148/158; 148/162; 148/408; 148/419

[58] Field of Search ..... 148/410, 162, 408, 419, 148/158; 420/445–451, 435–440, 583–586, 588

[56] References Cited

U.S. PATENT DOCUMENTS

| | | | |
|---|---|---|---|
| 2,575,915 | 11/1951 | Guy | 75/171 |
| 2,920,956 | 1/1960 | Nisbet et al. | 75/171 |
| 3,069,258 | 12/1962 | Haynes | 75/171 |
| 3,155,501 | 11/1964 | Kaufman et al. | 75/171 |
| 3,254,994 | 6/1966 | Quigg | 75/171 |
| 3,403,059 | 9/1968 | Barker | 148/32.5 |
| 3,619,183 | 11/1971 | Olson et al. | 75/171 |
| 3,653,987 | 4/1972 | Boesch | 148/162 |

(List continued on next page.)

FOREIGN PATENT DOCUMENTS 2133419B 10/1985 United Kingdom .

OTHER PUBLICATIONS

Article entitled "Carbides in Ni-Cr-Mo System", by Raghavan et al., from *Metallurgica*, vol. 17, pp. 1189–1194, 1983.

Article entitled "Determination of Isothermal Sections of Nickel Rich Portion of Ni-Cr-Mo System by Analytical Electron Microscopy", by Raghavan et al., from *Metallurgical Transactions* A, vol. 15A, pp. 783–792, May 1984.

Description of Inconel Alloy X-750 from *Alloy Digest*, Jul. 1986.

Manufacturer's Specifications for Incoloy Alloy 925 by Huntington Alloys.

Manufacturer's Specifications for Pyromet Alloy 31, by Carpenter Technology Corporation.

Manufacturer's Specifications for Udimet 625, by Special Metals.

Manufacturer's Specifications for Udimet 718, by Special Metals.

*Primary Examiner*—R. Dean

*Attorney, Agent, or Firm*—Kenneth C. Johnson; Gary D. Lawson

[57] ABSTRACT

The present invention provides Ni (and/or Co) base precipitation hardened alloy compositions having improved resistance to stress corrosion cracking and being comprised of:

12–25 wt. % Cr;

0–10 wt. % Mo;

0–12 wt. % W, with the proviso that Mo+0.5 W is ≧2 wt. % and ≦10 wt. % and with the proviso that Cr+Mo+0.5 W is ≦28 wt. %;

2–6 wt. % of one or more of Al, Nb, and Ti;

<0.05 wt. % C;

<0.05 wt. % O;

<0.05 wt. % N; and the balance being Ni (and/or Co) and any incidental impurities, wherein the concentrations of Ni (and/or Co), Cr and Mo (and/or W) are correlated so that their combination represents a point within the area ABCD of FIG. 1 hereof. Preferably, the ratio, expressed in atomic percent, of Al to Nb+Ti is between about 0 and 4.0, preferably between about 0.8 and 1.5, more preferably about 1. In addition, Hf is preferably included in a concentration, expressed in weight percent, of between about 10 (C+O+N) and 30 (C+O+N), more preferably between about 15 (C+O+N) and 20 (C+O+N). Up to 30 wt. % of the Ni (and/or Co) can be replaced with Fe, depending on the severity of the stress corrosion environment.

13 Claims, 3 Drawing Sheets

U.S. PATENT DOCUMENTS

| | | | |
|---|---|---|---|
| 3,667,938 | 6/1972 | Boesch | 75/171 |
| 3,677,746 | 7/1972 | Lund et al. | 75/171 |
| 3,677,747 | 7/1972 | Lund et al. | 75/171 |
| 3,681,059 | 8/1972 | Shaw et al. | 75/134 F |
| 3,705,827 | 12/1972 | Muzyka et al. | 148/142 |
| 3,707,409 | 12/1972 | Boesch et al. | 148/32.5 |
| 3,723,107 | 3/1973 | Richards et al. | 75/171 |
| 3,748,192 | 7/1973 | Boesch | 148/32.5 |
| 3,783,032 | 1/1974 | Walker et al. | 148/3 |
| 3,832,167 | 8/1974 | Shaw et al. | 75/170 |
| 3,850,624 | 11/1974 | Hulit et al. | 75/171 |
| 3,898,109 | 8/1975 | Shaw | 148/162 |
| 3,922,168 | 11/1975 | Restall et al. | 75/171 |
| 3,925,072 | 12/1975 | Shaw | 75/171 |
| 3,972,713 | 8/1976 | Muzyka et al. | 75/171 |
| 4,056,389 | 11/1977 | Shaw | 75/171 |
| 4,080,201 | 3/1978 | Hodge et al. | 75/171 |
| 4,108,647 | 8/1978 | Shaw | 75/171 |
| 4,116,723 | 9/1978 | Gell et al. | 148/3 |
| 4,168,188 | 9/1979 | Asphahani | 148/32 |
| 4,245,698 | 1/1981 | Berkowitz et al. | 166/244 |
| 4,248,629 | 2/1981 | Pons et al. | 75/122 |
| 4,292,076 | 9/1981 | Gigliotti et al. | 75/170 |
| 4,358,511 | 11/1982 | Smith, Jr. et al. | 428/595 |
| 4,386,976 | 6/1983 | Benn et al. | 148/410 |
| 4,400,209 | 8/1983 | Kudo et al. | 420/443 |
| 4,400,210 | 8/1983 | Kudo et al. | 420/443 |
| 4,400,211 | 8/1983 | Kudo et al. | 420/443 |
| 4,400,349 | 8/1983 | Kudo et al. | 420/443 |
| 4,402,772 | 9/1983 | Duhl et al. | 148/404 |
| 4,421,571 | 12/1983 | Kudo et al. | 148/11.5 R |
| 4,459,160 | 7/1984 | Meetham et al. | 148/3 |
| 4,464,210 | 8/1984 | Watanabe | 148/162 |
| 4,624,716 | 11/1986 | Noel et al. | 148/12.7 |

FRACTURE SURFACES OF SSR SAMPLES TESTED IN SOLUTION
(A) ALLOY I AND (B) ALLOY II, 25x

GRAIN BOUNDARY ATTACK IN (A) ALLOY I IS INDICATED
BY ARROWS.

NICKEL BASE PRECIPITATION HARDENED ALLOYS HAVING IMPROVED RESISTANCE STRESS CORROSION CRACKING

FIELD OF THE INVENTION

The present invention relates to Ni (and/or Co) base precipitation hardened alloy compositions having improved resistance to stress corrosion cracking.

BACKGROUND OF THE INVENTION

Increasingly, wells are being drilled to greater and greater depths for the production of oil and natural gas. As a result, alloy compositions used for the manufacture of well tubulars such as casing, tubing and drill pipe, and for the manufacture of downhole devices such as valves, are being subjected to increasingly hostile environments. Serious environmental factors having an adverse effect on such alloy compositions include corrosion, hydrogen embrittlement, and stress corrosion cracking. The most serious of these environmental factors is stress corrosion cracking, which consists of concentrated chemical attack on the material by the environment and which is aggravated by the high temperatures and stresses associated with deep and corrosive wells.

Considerable effort is being expended by the metallurgical industry to develop alloys for use in deep and corrosive wells. The alloys which have been developed are generally hardened or strengthened by cold working, as opposed to being precipitation hardened as are the alloys of the present invention.

Although some of the alloys developed have served the drilling industry with varying degrees of success, there is still a great need in the industry for the development of precipitation hardened alloys having improved strength and resistance to stress corrosion cracking.

SUMMARY OF THE INVENTION

In accordance with the present invention there is provided precipitation hardened alloy compositions which are substantially free of sigma, or other similar intermetallic phases, and which are resistant to stress corrosion cracking, which compositions are comprised of about:

12–25 wt. % Cr;
0–10 wt. % Mo;
0–12 wt. % W, with the proviso that Mo+0.5W is ≧2 wt. % and ≦10 wt. %, and with the proviso that Cr+Mo+0.5 W is ≦28 wt. %;
2–6 wt. % of one or more of Al, Nb, and Ti;
<0.05 wt. % C;
<0.05 wt. % O;
<0.05 wt. % N; and
the balancing being Ni (and/or Co) and any incidental impurities, wherein the concentrations of Ni (and/or Co), Cr, Mo (and/or W) are correlated so that their combination represents a point within the area ABCD of FIG. 1 hereof.

For improved resistance to stress corrosion cracking, it is preferred that the ratio, expressed in atomic percent, of Al to Nb+Ti be between about 0 and 4.0, preferably between about 0.8 and 1.5, more preferably about 1.

In addition, it is preferred that Hf be included in a concentration, expressed in weight percent, which is at least about 10 times the concentration of C+O+N, 10 (C+O+N), but less than about 30 (C+O+N), more preferably between about 15 (C+O+N) and 20 (C+O+N).

In other preferred embodiments of the present invention, up to 30 wt. % of Ni (and/or Co) is replaced with Fe.

DETAILED DESCRIPTION OF THE INVENTION

Metals and alloys are generally comprised of a multitude of crystallites called grains which are separated by grain boundaries. The grain boundaries are usually the weak link in the microstructure and become even weaker by the formation of second phase particles, or sigma phase, which agglomerate at the grain boundaries. These second phase particles are not desirable at the grain boundaries, because, when the microstructure is subjected to stress and an adverse environment, these particles are attacked, and a crack propagates along the grain boundaries resulting in premature failure.

Figure 1:
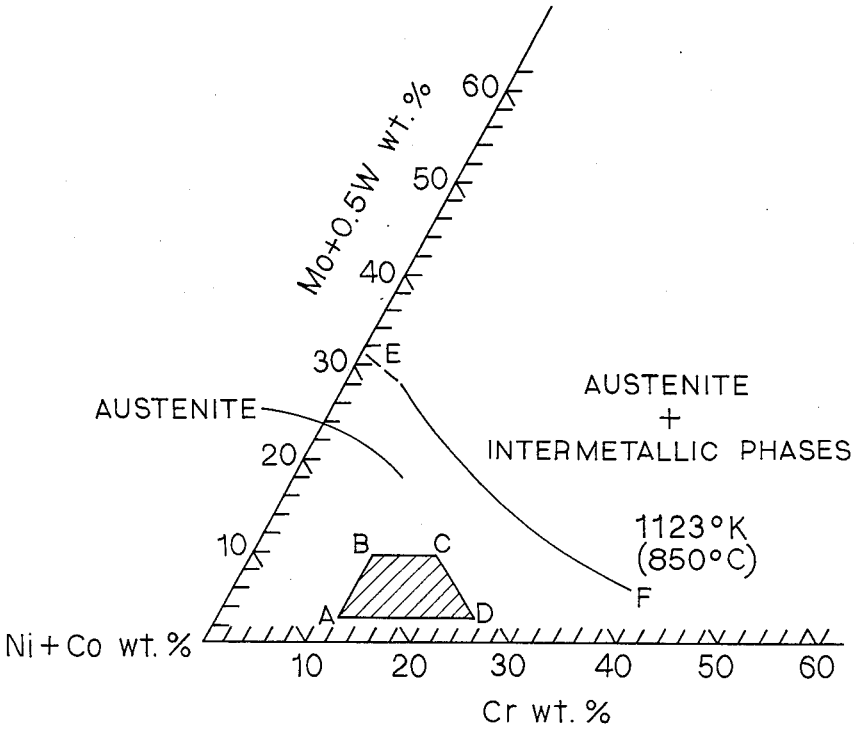
FIG. 1 is a phase diagram of the Ni (and/or Co)-Cr-Mo (and/or W) alloy system of the present invention wherein a window ABCD is identified showing the range of each element required to produce an alloy which is substantially free of sigma or other similar intermetallic phases.

In order to avoid the formation of these second phase particles, the inventors hereof have found that it is essential that the concentrations of Ni (and/or Co), Cr, and Mo (and/or W) be correlated so that their combination represents a point within the area ABCD of FIG. 1, and that the alloys be comprised of about:

12–25 wt. % Cr;
0–10 wt. % Mo;
0–12 wt. % W, with the proviso that Mo+0.5W is ≧2 wt. % and ≦10 wt. %, and with the proviso that Cr+Mo+0.5W is ≦28 wt.%;
2–6 wt. % of one or more of Al, Nb, and Ti;
<0.05 wt. % C;
<0.05 wt. % O;
<0.05 wt. % N; and
the balance being Ni and/or Co and any incidental impurities.

The alloys of the present invention may contain incidental elements which are normally present in Ni base and Co base alloys, such as B, Sn, Pb, Zn, Mg, Bi, etc., each in an amount preferably less than about 0.05 wt. %, as long as they do not render any substantial adverse effect on the properties of the alloy. In addition, the alloys of the present invention may also contain elements such as Mn and Si, each in an amount preferably less than about 2 wt. %, as long as they do not render any substantial adverse effect.

Although the elimination of these second phase particles is desirable with respect to crack propagation, an alloy containing only a single phase microstructure lacks the strength needed for deep and corrosive well service. In order to provide this strength, the alloys of the present invention are strengthened by adding one or more of Al, Nb and Ti, which, under the proper conditions, leads to the formation of a uniform distribution of extremely fine second phase particles. Although it is generally believed by those having ordinary skill in the metallurgical art that the addition of such elements would lead to the formation of extremely fine second phase particles, it is also believed that coarse second phase precipitates at the grain boundaries would also form. The coarse second phase precipitates at the grain boundaries would be detrimental to the stress corrosion cracking resistance of the resulting alloy. The inventors hereof have unexpectedly found that the formation of these coarse second phase precipitates can be avoided if one or more of Al, Nb and Ti are added under the following conditions: (a) the total concentration of Al, Nb and Ti is between 2 and 6 wt. %, (b) the ratio, expressed in atomic percent, of Al to Nb+Ti is between about 0 and 4.0, preferably between about 0.8 and 1.5, more preferably about 1, and (c) the concentration of Cr+Mo+0.5 W is ≦28 wt. %.

Another phenomenon which is detrimental to stress corrosion cracking resistance is the precipitation of chromium carbides which deplete the grain boundaries and neighboring regions of Cr and/or Mo, thereby rendering the alloy susceptible to intergranular stress corrosion cracking. The inventors hereof have discovered that the addition of Hf in a concentration, based on weight percent, which is between about 10 (C+O+N) and 30 (C+O+N), preferably between about 15 (C+O+N) and 20 (C+O+N), eliminates the precipitation of chromium carbides at the grain boundaries, thus resulting in an alloy having improved resistance to stress corrosion cracking.

The elements, and their concentrations, comprising the alloys of the present invention are important because their combination results in an alloy having unexpectedly good stress corrosion cracking resistance. For example, Ni is important for two reasons. The first is to increase the resistance of the alloy to chloride stress corrosion cracking, and the second is to help prevent the formation of sigma, or similar intermetallic phases. It is understood that some, or all, of the Ni can be replaced with Co without any detrimental effect on the resulting alloy.

Cr is important because it increases the overall corrosion resistance of the alloy. It must be noted though that increasing amounts of Cr lead to the formation of sigma, or other similar intermetallic phases. The amount of Cr needed to provide corrosion resistance is directly related to the severity of the corrosive environment. Generally, the minimum amount of Cr needed to provide corrosion resistance is about 12 wt. %, while a Cr content of up to about 25 wt. % may be needed in more severe corrosive environments. In the alloys of the present invention, a Cr content greater than about 25 wt. % could lead to undesirable sigma, or other similar intermetallic phases.

Mo (and/or W) are present to increase the resistance of the alloy to pitting corrosion, especially in a chloride-containing environment. It is important for the alloys of the present invention that when both Mo and W are used, they be used in relation to one another such that Mo+0.5W≧2 wt. % and ≦10 wt. %. If W is used alone, then up to 12 wt. % of it may be used. The amount of Mo (and/or W) present in the alloy is related to the severity of the environment.

With respect to the elimination of sigma, or other similar intermetallic phases, it is important that the concentrations of Ni (and/or Co), Cr, Mo (and/or W) be correlated so that their combination represents a point within the area ABCD of FIG. 1. In FIG. 1, lines AB and AD represent the lower limits for Cr and Mo (and/or W), respectively, which are required to provide the minimum resistance to corrosion and cracking. Lines BC and CD represent the upper limits for Mo and Cr (and/or W), respectively, above which the alloy is prone to the precipitation of intermetallic phases.

It is important to select alloy compositions within the area represented by ABCD because, upon subsequent hardening heat treatment, the matrix phase (gamma, $\gamma$) of the resulting heat treated product gets enriched in Cr and Mo, but still remains below the line defined by E and F of FIG. 1. In cases where a certain amount of sigma, or other similar intermetallic phases, can be tolerated, then strict adherence to the above correlation is not critical, although the amounts of each element used must still be in the ranges previously identified herein.

The use of Hf in the alloys of the present invention results in the formation of stable hafnium carbides. The formation of hafnium carbides removes C from the metal matrix and suppresses the precipitation of chromium carbides at the grain boundaries. The formation of chromium carbides at the grain boundaries is detrimental to the properties of the alloys of the present invention because they preferentially deplete the grain boundaries of Cr, which is needed to protect against corrosion.

For economical purposes, up to about 30 wt. % of the Ni (and/or Co) may be replaced with Fe. However, addition of Fe reduces the maximum amounts of Cr and Mo (and/or W) that can be allowed to maintain the alloy free of sigma, or other similar intermetallic phases. As a higher concentration of Fe is added to the alloy, there needs to be a corresponding decrease in the levels of Cr and Mo (and/or W). For example, when the alloy contains no Fe, up to about 28 wt. % of Cr+Mo+0.5W can be allowed in the alloy. However, if the alloy contains 20 wt. % Fe, the level of Cr+Mo+0.5W will preferably be limited to about 24 wt. % to avoid the formation of undesirable precipitates. If the alloy contains 30 wt. % Fe, the level of Cr+Mo+0.5W will preferably be limited to about 21 wt. %. The permissible level of Fe in an alloy depends on the severity of the stress corrosion cracking environment. For environments which are relatively mild, an Fe content up to about 30 wt. % may be allowed, but for environments which are relatively severe, the Fe content should be limited to less than about 5 wt. %.

More particularly, for environments which are relatively mild with regard to stress corrosion cracking, the alloys are preferably comprised of about: 12 to 18, more preferably 15 to 18 wt. % Cr; 2 to 4, more preferably about 3 wt. % Mo; 0 to 3 wt. % W, with the proviso that Mo+0.5W≧2 wt.% and ≦4 wt. %, 2 to 6 wt. % of one or more of Al, Nb, and Ti, wherein the ratio, expressed in atomic percent, of Al to Nb+Ti is between 0 and 4.0, preferably between 0.8 and 1.5, more preferably about 1; <0.05 wt. % C; <0.05 wt. % 0; <0.05 wt. % N; 10 (C+O+N) to 30 (C+O+N), more preferably 15 (C+O+N) to 20 (C+O+N) wt. % Hf; 0 to 30 wt. % Fe; and the balance being Ni (and/or Co) and any incidental impurities.

For more severe stress corrosion environments, it is preferred that the alloys of the present invention be comprised of about: 18 to 25, more preferably about 22 Wt. % Cr; 4 to 10, more preferably about 6 wt. % Mo; 0 to 12 wt. % W, with the proviso that Mo+0.5W is ≧2 wt. % and ≦10 wt. %; 2 to 6 wt. % of one or more of Al, Nb, and Ti, wherein the ratio, expressed in atomic percent, of Al to Nb+Ti is between 0 and 4.0, preferably between 0.8 and 1.5, more preferably about 1; <0.05 wt. % C; <0.05 wt. % 0; <0.05 wt. % N; 10 (C+O+N) to 30 (C+O+N), more preferably 15(C+O+N) to 20 (C+O+N) wt. % Hf; 0 to 10, more preferably <5 wt. % Fe; and the balance being Ni (and/or Co) and any incidental impurities. The maximum Cr+Mo+0.5W level is limited to about 26–28 wt. % depending on the concentration of Fe.

The following Examples 1–11 serve to more fully describe the present invention. It is understood that these examples in no way serve to limit the true scope of the invention, but rather, are presented for illustrative purposes.

The experimental alloys used for Examples 1–8 were prepared from substantially pure-element raw materials. The individual elements were weighed to constitute about 50 lbs. and melted in a vacuum induction furnace. Once the major alloying elements were molten, the molten metal was poured into a 2½" diameter cast iron mold. The solidified ingots were stripped from the mold, homogenized at 1200° C. for 24 hours, and hot rolled at 1000° C. to produce ½" thick plates. Sections were cut from the plates and were further cold reduced to produce ⅛" thick plates used to make machine test samples.

EXAMPLES 1–4

In these Examples, Alloy I which contains no Hf (Examples 1 and 2), and Alloy II which contains 0.5 wt. % Hf (Examples 3 and 4), were tested for susceptibility to stress corrosion cracking in order to examine the effect of Hf. The test, a dynamic slow strain rate (SSR) test, was performed by deforming tensile samples machined from the ⅛" thick plates described above at a very slow strain rate ($4\times10^{-6}$/sec), whereupon the yield strength (YS), tensile strength (TS), and time to failure ($t_f$) were recorded. In each test, the entire tensile sample was immersed in a solution comprised of 25% NaCl and 0.5% acetic acid, saturated with $H_2S$, and maintained at a temperature of 200° C. The time to failure of each sample is an indication of its susceptibility to the corrosive solution. Since the time to failure also depends on the yield strength, a comparison can be made only on alloys which have comparable yield strengths, as in Examples 1–4. The data in Table I show that the failure times of Alloy I (Examples 1 and 2) were considerably lower than the failure times of Alloy II (Examples 3 and 4). This evidences that, due to its Hf content, Alloy II was considerably more resistant to the corrosive solution than Alloy I.

TABLE I

Slow Strain Rate Test Results
Test Temp: 200° C.

| Example | Alloy # | Heat Treatment (°C./hrs) | Environment (air/soln) | YS Ksi | TS Ksi | Failure time (hrs) |
|---|---|---|---|---|---|---|
| 1 | I | 1040/1 + 815/8 | Soln | 76.5 | 116.6 | 14 |
| 2 | I | 1040/1 + 700/8 | Soln | 82.9 | 123 | 16.4 |
| 3 | II | 1040/1 + 815/12 | Soln | 80.8 | 146 | 33.1 |
| 4 | II | 1040/1 + 700/7 | Soln | 75.8 | 126.9 | 25.4 |

Alloy I: Ni—18Cr—8Mo—2Al—2Nb wt. %
Alloy II: Ni—18Cr—8Mo—2Al—2Nb—0.5Hf wt. %

Figure 2A:
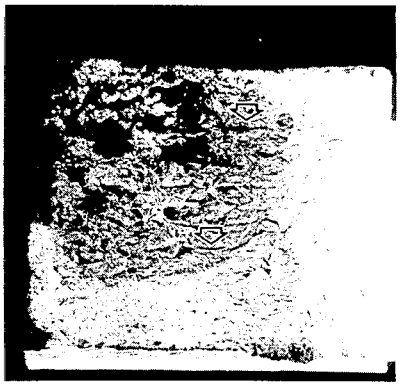
FIGS. 2A and 2B are photomicrographs (25×) showing the fracture morphology of two alloys after undergoing the dynamic slow strain rate tests of Examples 1–4 hereof.
Figure 2B:
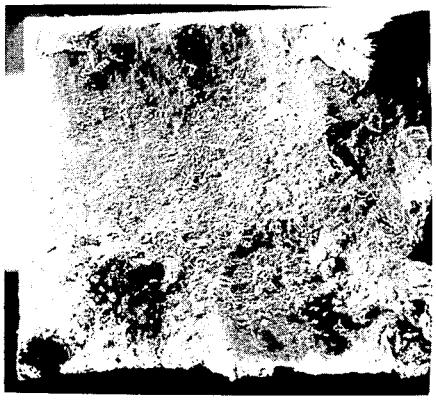

The susceptability of an alloy to stress corrosion cracking can also be determined from the fracture morphology of the SSR samples tested in solution, as shown in FIGS. 2A and 2B. FIG. 2A shows the fracture surface of a sample of Alloy I, which does not contain Hf. Numerous failures along the grain boundaries can be seen as indicated by the arrows. FIG. 2B shows the fracture surface of a sample of Alloy II, which contains Hf; the fracture mode is totally transgranular with no indications of grain boundary failure. Grain boundary failures are an indication of susceptibility to stress corrosion cracking. The coarse particles on the fracture surface are chloride particles deposited from the solution after the test.

EXAMPLES 5–8

In Examples 5–8, two SSR tests were performed on each of three alloys—one in air and the other in the solution of Examples 1–4 above. The tensile samples were prepared in the same fashion as those described in Examples 1–4 above. The ratio of the failure time in solution over the failure time in air was determined for each alloy. If an alloy is immune to the solution, then the ratio of failure time in solution to failure time in air would be 1. The further below 1 that the ratio is for an alloy, the more susceptible the alloy is to attack by the solution. Table II shows the SSR test results for Alloys I and II. As seen therein, Alloy II showed the higher resistance to the corrosive solution with a ratio of 1.05, while Alloy I had a ratio of 0.94. Alloy II had a compositional advantage over Alloy I in accordance with one aspect of the present invention due to its HF content.

TABLE II

Slow Strain Rate Test Results

| Example | Alloy # | Heat Treatment (°C./hours) | Environment (air/soln) | YS Ksi | TS Ksi | Test Temperature (°C.) | Failure time ($t_f$) (hrs) | Ratio of $t_f$(soln) / $t_f$(air) |
|---|---|---|---|---|---|---|---|---|
| 5 | I | 1040/1 + 760/16 | Air | 85.7 | 141.5 | 200 | 31 | 0.94 |
| 6 | I | 1040/1 + 760/16 | Soln | 83.8 | 145 | 200 | 29.1 | |
| 7 | II | 1040/1 + 760/16 | Air | 88.2 | 153 | 200 | 28.5 | 1.05 |

TABLE II-continued

| Example | Alloy # | Heat Treatment (°C./hours) | Slow Strain Rate Test Results: Environment (air/soln) | YS Ksi | TS Ksi | Test Temperature (°C.) | Failure time ($t_f$) (hrs) | Ratio of $t_f$(soln) / $t_f$(air) |
|---|---|---|---|---|---|---|---|---|
| 8 | II | 1040/1 + 760/16 | Soln | 91 | 153 | 200 | 29.8 | |

Alloy I: Ni—18 Cr—8 Mo—2 Al—2 Nb
Alloy II: Ni—18 Cr—8 Mo—2 Al—2 Nb—0.5 Hf

EXAMPLES 9-11

These Examples demonstrate that the formation of course intermetallic precipitates is dependent on the ratio of Al to Nb+Ti. The effect of the ratio of Al to Nb (which would be same as the effect on the ratio of Al to Ti) expressed in atomic percent is shown in Table IV. The alloys in these examples contain the same base elements, that is, Cr, Fe, and Ni, but differ only in the ratio of Al to Nb. Mo was not included in these compositions because it would have little, if any, effect on the formation of course intermetallic precipitates resulting from unfavorable Al/Nb ratios.

Figure 3A:
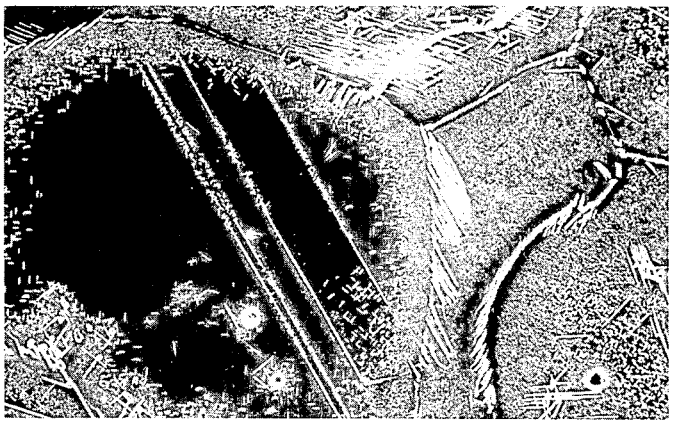
FIGS. 3A, 3B, and 3C are photomicrographs (1000×) of alloys from Examples 9, 10 and 11 hereof showing the effect of various ratios of Al/Nb with respect to the formation of coarse intermetallic phases.
Figure 3B:
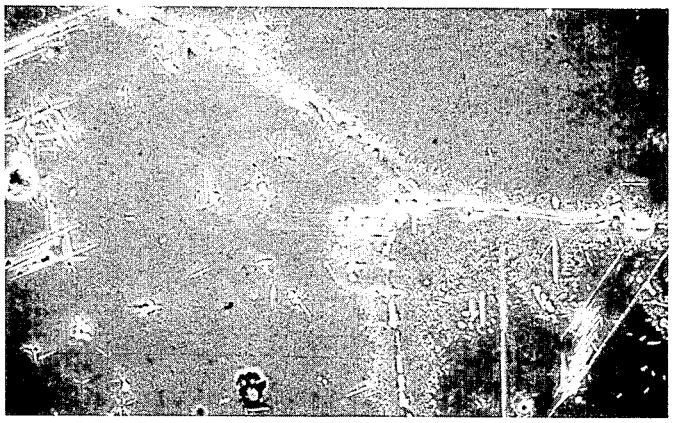
Figure 3C:
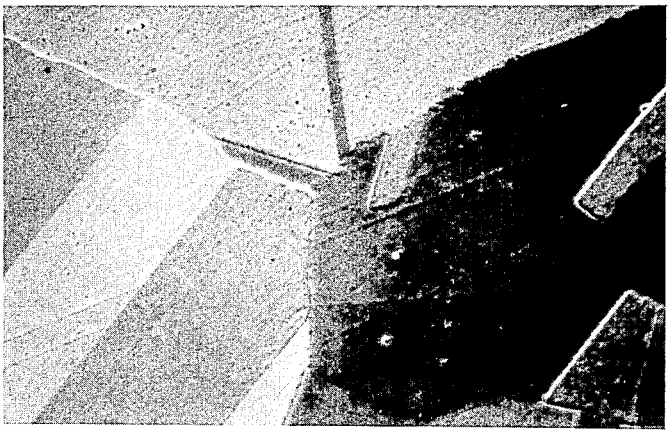

The alloys used in Examples 9-11 were prepared by arc melting pure elemental powders. A 50 gm weight sample of metal powder of the desired composition (Table III) was mixed, cold compacted, and melted into a button using an electrical arc. Each button was melted several times to achieve homogeneity. The buttons were homogenized at 1250° C. for one hours, cold rolled to about 0.065" thick sheets, and subsequently annealed at 1000° C. for one hour followed by water quenching. These samples were aged at 815° C. for 16 hours. Scanning microscopic analysis of the aged samples are shown in FIGS. 3A-C. FIGS. 3A and 3B are from Examples 9 and 10, respectively, and show the formation of course intermetallic phases of the type $Ni_3Nb$, whereas FIG. 3C shows the absence of course intermetallic phases in Example 11. This illustrates that when the ratio of Al to Nb+Ti (expressed in atomic percent) is in the preferred range of 0.8 to 1.5, undesirable course intermetallic phases did not form.

TABLE III

| Example | Composition | Ratio of Al/Nb |
|---|---|---|
| 9 | Ni—25 Cr—20 Fe—1.13 Al—3.01 Nb | 0.38 |
| 10 | Ni—25 Cr—20 Fe—1.71 Al—2.72 Nb | 0.63 |
| 11 | Ni—25 Cr—20 Fe—2.25 Al—1.7 Nb | 1.32 |

What is claimed is:

1. A precipitation hardened alloy resistant to stress corrosion cracking which is substantially free of sigma phase particles and substantially free of chromium carbides at grain boundaries, the alloy composition consisting essentially of:
   - 12-25 wt.% Cr;
   - 0-10 wt.% Mo;
   - 0-12 wt.% W with the proviso that Mo+0.5 W is ≧2 wt.% and ≦10 wt.%, and with the proviso that Cr+Mo+0.5 W is ≦28 wt.%;
   - 2-6 wt.% of one or more of Al, Nb and Ti, wherein the ratio, expressed in atomic percent, of Al to Nb+Ti is between 0 and 4.0;
   - <0.05 wt.% C;
   - <0.05 wt.% O;
   - <0.05 wt.% N, with the proviso that C+O+N is greater than zero;
   - Hf in a concentration, expressed in weight percent, of between 10 (C+O+N) and 30 (C+O+N); and
   - the balance being Ni (and/or Co) and any incidental impurities, wherein the concentration of Ni (and/or Co), Cr and Mo (and/or W) are correlated so that their combination represents a point within the area of ABCD of FIG. 1 hereof.

2. The precipitation hardened alloy of claim 1 wherein the ratio, expressed in atomic percent, of Al to Nb+Ti is between about 0.8 and 1.5.

3. The precipitation hardened alloy of claim 1 wherein the concentration of Hf, expressed in weight percent, is between about 15 (C+O+N) and 20 (C+O+N).

4. The precipitation hardened alloy of claim 1 wherein up to 30 wt. % of Ni (and/or Co) is replaced with Fe.

5. A well tubular manufactured from the precipitation hardened alloy of claim 1.

6. A precipitation hardened alloy resistant to stress corrosion cracking which is substantially free of sigma phase particles and substantially free of chromium carbides at grain boundaries, the alloy composition consisting essentially of:
   - 12-18 wt. % Cr;
   - 2-4 wt. % Mo;
   - 0-3 wt. % W, with the proviso that Mo+0.5 W is ≧2 wt. % and ≦4 wt. %;
   - 2-6 wt. % of one or more of Al, Nb and Ti, wherein the ratio, expessed in atomic percent, of Al to Nb+Ti is between 0 and 4.0;
   - <0.05 wt. % C;
   - <0.05 wt. % O;
   - <0.05 wt. % N, with the proviso that C+O+N is greater than zero;
   - Hf in a concentration, expressed in weight percent, of between 10 (C+O+N) and 30 (C+O+N);
   - 0-30% Fe; and
   - the balance being Ni (and/or Co) and any incidental impurities, wherein the concentrations of Ni (and/or Co), Cr and Mo (and/or W) are correlated so that their combination represents a point within the area of ABCD of FIG. 1 hereof.

7. The precipitation hardened alloy of claim 6 wherein the concentration of Cr is about 15-18 wt. %, wherein the concentration of Mo is about 3 wt. %, wherein the ratio, expressed in atomic percent, of Al to Nb+Ti is between about 0.8 and 1.5, and wherein Hf is in a concentration, expressed in weight percent, of about 15 (C+O+N) to 20 (C+O+N).

8. The precipitation hardened alloy of claim 6 wherein the ratio, expressed in atomic percent, of Al to Nb+Ti is about 1.

9. A well tubular manufactured from the precipitation hardened alloy of claim 6.

10. A precipitation hardened alloy resistant to stress corrosion cracking which is substantially free of sigma phase particles and substantially free of chromium carbides at grain boundaries, the alloy composition consisting essentially of:

18–25 wt. % Cr;

4–10 wt. % Mo;

0–12 wt. % W, with the proviso that Mo+0.5 W is ≧2 wt. % and ≦10 wt. %, an with the proviso that Cr+Mo+0.5 W is ≦28 wt. %;

2–6 wt. % of one or more of Al, Nb and Ti, wherein the ratio, expressed in atomic percent, of Al to Nb+Ti is between 0 and 4.0;

<0.05 wt. % C;

<0.05 wt. % O;

<0.05 wt. % N, with the proviso that C+O+N is greater than zero;

Hf in a concentration, expressed in weight percent, of between 10 (C+O+N) and 30 (C+O+N);

0–10 wt. % Fe; and the balance being Ni (and/or Co) and any incidental impurities, wherein the concentrations of Ni (and/or Co), Cr and Mo (and/or W) are correlated so that their combination represents a point within the area of ABCD of FIG. 1 hereof.

11. The precipitation hardened alloy of claim 10 wherein the concentration of Cr is about 2 wt. %, wherein the concentration of Mo is about 6 wt. %, wherein the ratio, expressed in atomic percent, of Al to Nb+Ti is between about 0.8 and 1.5, wherein Hf is in a concentration, expressed in weight percent, of about 15 (C+O+N) to 20 (C+O+N), and wherein the concentration of Fe is about 0–5 wt. %.

12. The precipitation hardened alloy of claim 10 wherein the ratio, expressed in atomic percent, of Al to Nb+Ti is about 1.

13. A well tubular manufactured from the precipitation hardened alloy of claim 10.

* * * * *

UNITED STATES PATENT AND TRADEMARK OFFICE

CERTIFICATE OF CORRECTION

PATENT NO. : 4,755,240

DATED : July 5, 1988

INVENTOR(S) : Raghavan Ayer, Glen Allen Vaughn, LaurenceJoseph Sykes

It is certified that error appears in the above-identified patent and that said Letters Patent is hereby corrected as shown below:

Column 10, Line 8 should be:

"wherein the concentration of Cr is about 22 wt. %"

Signed and Sealed this

Twenty-fourth Day of August, 1993

Bruce Lehman

*Attest:*

BRUCE LEHMAN

*Attesting Officer*

*Commissioner of Patents and Trademarks*